US006920651B2

(12) United States Patent
Roberts

(10) Patent No.: US 6,920,651 B2
(45) Date of Patent: Jul. 26, 2005

(54) SURFING RING WAVE POOL FOR GENERATING MULTIPLE SIMULTANEOUS ENDLESS TRAVELING WAVES LOOPING AROUND A CENTER ISLAND

(76) Inventor: Michael Kevin Roberts, 8 Torrey Pines Ct., Ormond Beach, FL (US) 32174

( * ) Notice: Subject to any disclaimer, the term of this patent is extended or adjusted under 35 U.S.C. 154(b) by 118 days.

(21) Appl. No.: 10/454,289

(22) Filed: Jun. 5, 2003

(65) Prior Publication Data

US 2004/0245780 A1 Dec. 9, 2004

(51) Int. Cl.[7] ..... A47K 3/10
(52) U.S. Cl. ..... 4/491; 405/79
(58) Field of Search ..... 4/491, 497, 541.1; 405/52, 79

(56) References Cited

U.S. PATENT DOCUMENTS 3,350,724 A * 11/1967 Leigh ..... 4/491
3,562,823 A * 2/1971 Koster ..... 4/491
3,913,332 A * 10/1975 Forsman ..... 405/79
4,522,389 A * 6/1985 Malcolm ..... 4/491
4,692,949 A * 9/1987 Dunn ..... 4/491
4,812,077 A * 3/1989 Raike ..... 405/79
4,905,987 A * 3/1990 Frenzi ..... 472/117
4,976,570 A * 12/1990 Davis et al. ..... 405/79
6,336,771 B1 * 1/2002 Hill ..... 405/79

* cited by examiner

*Primary Examiner*—Tuan Nguyen
(74) *Attorney, Agent, or Firm*—Stevens Davis

(57) ABSTRACT

A circular ring wave pool having an island in the center, the pool water depth becomes deeper the farther away from the island to the outside pool wall. A plurality of wave generators encompass the entire outer wall deep side of the pool. All wave generators point directly to the center of the island. Wave generators are synchronized in their action to produce waves that travel around the circular ring shaped pool in an endless loop therefore creating a traveling surfing wave that never ends. Many waves can be generated simultaneously creating a plurality of endless waves moving around the island. The sloping beach is at an angle to create a hollow tube breaking wave depending on wave speed and size. Hundreds of surfers can be in the pool at the same time all sitting out past the wave breakpoint waiting for an available wave to pass.

19 Claims, 1 Drawing Sheet

(TOP VIEW)

(CROSS SECTION - DETAIL)

SURFING RING (TOP VIEW)

(CROSS SECTION)

(CROSS SECTION - DETAIL)

SURFING RING WAVE POOL FOR GENERATING MULTIPLE SIMULTANEOUS ENDLESS TRAVELING WAVES LOOPING AROUND A CENTER ISLAND

BACKGROUND OF THE INVENTION

There has been a need to produce traveling waves that a surfer can ride for a very long time. Most surfing waves in nature can only be ridden for about 5 to 10 seconds. This fact makes learning how to surf and acquire trick skills very difficult. Previous traveling wave surfing machine, designs fail to address this need. They also produce waves that can be ridden for only about 5 to 10 seconds and they only produce a few-waves (usually one) at a time. Therefore they greatly limit the riding time per surfer and number of surfers that can be having fun surfing at the same time. This invention is unique because it, features endless traveling waves and dozens of surfers can use it simultaneously because it can produce dozens of waves following each other around the pool at the same time. The time a surfer has to ride the wave is only limited by their ability to stay with the wave or until the wave generators are shut off or changed to the next wave pattern or direction. Hundreds of surfers can be in the water waiting out past the breakpoint for an available wave to come around. Then the surfer can take off on the wave riding it until the surfer wipes out or the wave generators are changed. It is estimated that this invention will greatly decrease the time for a surfer to acquire new skills because the opportunity to learn new skills is greatly expanded beyond that in nature and for previous traveling wave machine designs.

BRIEF SUMMARY OF THE INVENTION

A circular ring wave pool for surfing having an island in the center, the pool water depth becomes deeper the farther away from the island to the outside pool wall. A plurality of wave generators encompass the entire outer wall deep side of the pool. All wave generators point directly to the center of the island. Wave generators are synchronized in their action with adjacent wave generators to produce waves that travel around the circular pool in an endless loop therefore creating a traveling surfing wave that has no end. Many waves can be generated simultaneously creating dozens of endless waves moving around the island. Wave generators are designed to rapidly produce large surfing waves with minimal water surface disturbance near the wave generator.

DETAILED DESCRIPTION OF THE INVENTION

Figure 1:
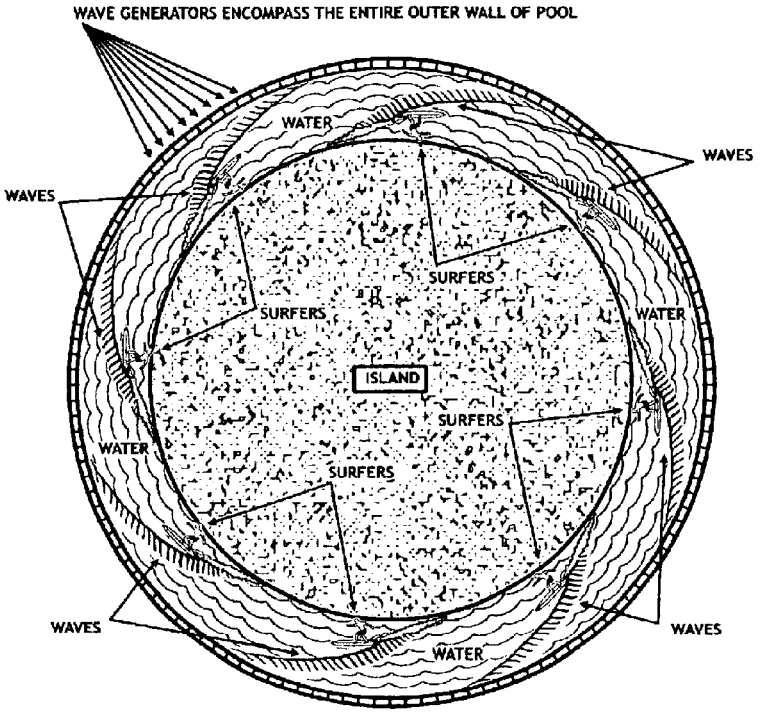
FIG. 1 Description: This is a top view looking down at the wave pool and island. A plurality of wave generators encompass the entire outer wall and deepest side of the pool. Eight breaking waves with surfers riding them are traveling clockwise around the pool. The surfers are going left as they travel around the island in endless circles.
Figure 2:
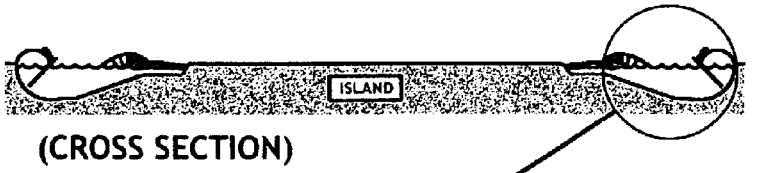
FIG. 2 Description: Cross Section showing the island and pool. The wave generators are on the outer walls.

The invention is a ring shape wave pool (FIG. 1) for surfing having an island in the center and a plurality of wave generators encompassing the entire outer wall deep side of the pool. All wave generators point to the center of the island. The invention is based on the ability to create a traveling wave which will circle the island that is generated by activation of adjacent narrow wave generators in a clockwise or counter-clockwise sequence. The resulting composite, Wave travels around the island in continuous loops. Many composite waves can be generated simultaneously creating a continuous train of endless waves moving around the island. The total number of waves that can be produced at one time is limited by the circumference of the pool, the wave lengths being produced and the composite wave speed time to travel around the island. Waves of various sizes can be generated concurrently all traveling around the wave pool at the same speed and direction. Waves can be changed in size and shape dynamically as the wave travels around the pool. Wave speeds around the pool can also be changed where usually all concurrent waves are sped up or slowed down to the same speed.

The ring shape pool allows the composite waves to travel around the island in endless loops providing surfers with riding time unparalleled by any other traveling wave machine design. The shape of the pool bottom (FIG. 3) is designed for both producing hollow breaking waves and optimizing wave generator performance.

Figure 3:
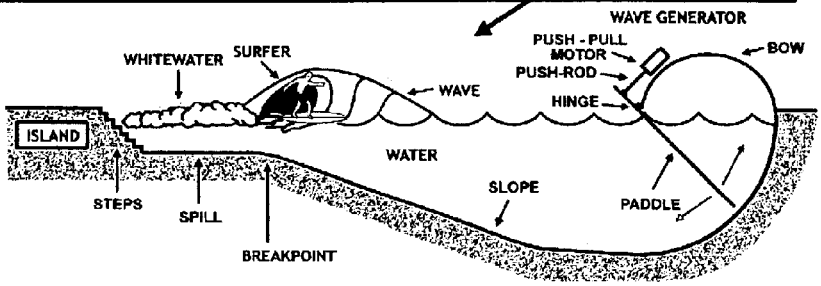
FIG. 3 Description: Cross Section—Detail showing one side of the pool. Wave Generator parts, Slope, Breakpoint, Steps, and Island are shown. Also, a wave, surfer and whitewater in approximate position as where they would be during operation. The wave generator pushes then pulls on the paddle in the pool water. This action creates a wave that travels toward the island up the slope where it forms into a steep wave. The wave breaks at or near the breakpoint creating whitewater that strikes the steps and is directed back toward the outer wall where the wave generator repeats the process.

The steps (FIG. 3) leading into the pool from the island serve as seating for spectators to watch the incredible surfing action, and as wave energy reflectors that help produce steeper more hollow waves when their reflected energy meets the next wave at or near the breakpoint. From the steps to the breakpoint is a shallow area that is approximately 3 to 5 feet deep and about 20 feet wide. This area acts as the wave spill and wipeout safe area. The breakpoint (FIG. 3) is approximately 4 feet deep. It functions to force all waves greater than 3 feet to break at that point. The smallest waves (3–4 feet) may not break as hollow waves but rather as spilling waves but larger waves will break more hollow as wave size increases. The breakpoint gently curves deeper to the slope (FIG. 3).

The slope increases in depth 1 foot deeper for every 4 feet farther away from the breakpoint. This angle causes waves to peek up and break as very hollow steep waves when the wave reaches the breakpoint. The slope is approximately 40 feet wide. The maximum depth of the pool water is about 14 feet deep. The slope ends directly under the wave generator hinge (FIG. 3). Here begins the part of the pool bottom that is really part of the wave generator. The pool bottom now swings up toward the water surface in a 90 degree inverted arch where the distance from the hinge (FIG. 3) to the pool bottom/side is constant at about 16 feet. The entire width of one side of the pool is approximately 76 feet wide from steps to outer pool wall.

The wave generators (FIG. 3) are designed to rapidly produce large surfing waves with minimal surface water disturbance near the paddle(s). Each wave generator is approximately 24 inches wide. The reason the wave generators are narrow is so the face of the composite wave will be smooth. If the wave generators were wide then the face of the composite wave would be choppy or bumpy to ride. The major components of a wave generator are the paddle, the push-pull motor, the bow and the hinge. The paddle is hinged to the bow (FIG. 3) near the water surface. The push-pull motor is mounted to the bow and the motor push-rod is attached to the top of the paddle. The long section of the paddle below the hinge extends deep into the water almost touching the pool bottom. The paddle starting position is vertical. The top of the paddle is pushed then pulled back and forth in the pool by the push-pull motor action. The pushing action causes the paddle to push water away from the island. This causes the water to fall directly in front of the paddle toward the island while water rises on the back side of the paddle. The falling water creates a shock wave that reflects off the bottom of the pool then comes up reflects off the paddle and produces a wave that now begins to travel toward the island. Now the paddle is pulled by the push-pull motor. This pulling pushes water towards the island reinforcing the existing wave created by the first action of the paddle. Additionally wave energy is reflected off the bottom of the pool towards the breakpoint where the wave energy will peak up into a steep hollow breaking wave. The distance and speed the paddle moves determine the size and wave length of the waves produced. The wave generators can produce a single wave with just one push-pull cycle or rapid series of waves with the push-pull cycle looping repeatedly.

All wave generators are controlled by a computer system that synchronizes their action such that each paddle is activated in a series rotating clockwise or counter-clockwise around the pool. The delay to activate the next paddle controls the speed that a composite wave travels around the island. The shorter the delay, the faster the composite wave moves around the island. The computer system also controls each wave generators' push or pull action, power and duration. These variables control wave speed toward the island and size of the wave. Since the computer system controls hundreds, perhaps even more than a thousand wave generators (depending on pool circumference) each with a wide range of variables, an almost limitless variety and number of endless surfing waves can be rapidly created by this invention.

I claim:

1. A circular ring wave pool, said pool being of annular shape having an outer periphery and inner peripheral boundary;

wave generators located proximate said outer peripheral boundary;

said wave generators each comprising a paddle, said paddle being pivotably connected to a point near the surface of the water in said pool; and a source of reciprocating motion to cause the paddle to alternately push water away from and towards the inner peripheral boundary.

2. The circular ring wave pool according to claim 1, wherein the inner periphery circumscribes an island in the center of said pool.

3. The circular ring wave pool according to claim 1, further including a bow positioned adjacent the outer periphery of said pool.

4. The circular ring wave pool according to claim 3, wherein to said paddle is hingedly connected to said bow.

5. The circular ring wave pool according to claim 4, further comprising a level of water therein, wherein said hingedly connection of said paddle to said bow is at a location at or above the level of said water in said pool.

6. The circular ring wave pool according to claim 1, wherein there are present a plurality of paddles, and further comprising a computer system that synchronizes the action of each paddle to cause activation of each paddle in series with other paddles.

7. The circular ring wave pool according to claim 6, wherein said computer system further controls the paddle motion, power and duration of movement.

8. The circular ring wave pool according to claim 6, wherein said computer system can cause the waves to be changed in shape or size at any time as the wave travels around the pool.

9. The circular ring wave pool according to claim 1, further comprising a computer system to control wave speed of all concurrent waves traveling around the pool.

10. The circular ring wave pool according to claim 1, further comprising a bottom between said inner and outer peripheral boundaries, the depth of said bottom being deeper adjacent the outer peripheral boundary than at a point nearer the inner peripheral boundary.

11. The ring wave pool according to claim 10, wherein the bottom comprises a breakpoint nearer the inner peripheral boundary and remote from the outer peripheral boundary.

12. The ring wave pool according to claim 11, wherein there is located a wave spill between said breakpoint and said inner peripheral boundary.

13. The ring wave pool according to claim 12, wherein said wave spill has a depth less than the depth at said breakpoint.

14. The ring wave pool according to claim 12, wherein said wave spill has a depth greater than the depth at said breakpoint.

15. The ring wave pool according to claim 1, wherein the inner peripheral boundary further comprises steps.

16. The ring wave pool according to claim 11, wherein the bottom has a slope of one foot deeper for every four feet axially distal from the breakpoint.

17. The circular ring wave pool according to claim 1, wherein said paddles are approximately 24 inches wide.

18. The circular ring wave pool according to claim 1, wherein said source of reciprocating motion are push-pull motors.

19. The circular ring wave pool according to claim 1, wherein the bottom of the pool adjacent the paddle is shaped so as to create a shock wave reflected off a bottom of the pool when the paddle pushes water away from said inner peripheral boundary.

* * * * *